US008906223B2

(12) United States Patent
Moser et al.

(10) Patent No.: US 8,906,223 B2
(45) **Date of Patent: *Dec. 9, 2014**

(54) HIGH TEMPERATURE REFORMING PROCESS FOR INTEGRATION INTO EXISTING UNITS

(71) Applicant: UOP LLC, Des Plaines, IL (US)

(72) Inventors: Mark D. Moser, Elk Grove Village, IL (US); Clayton C. Sadler, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 44 days.

This patent is subject to a terminal disclaimer.

(21) Appl. No.: 13/682,141

(22) Filed: Nov. 20, 2012

(65) Prior Publication Data

US 2014/0142358 A1 May 22, 2014

(51) Int. Cl.
*C10G 35/04* (2006.01)
*C10G 35/24* (2006.01)

(52) U.S. Cl.
CPC ..... *C10G 35/04* (2013.01)
USPC ..... 208/63; 208/64; 208/65; 208/133; 208/134; 208/141

(58) Field of Classification Search
CPC ..... C10G 35/24; C10G 35/04; C07C 15/00
USPC ..... 208/133, 134, 141, 63, 64, 65
See application file for complete search history.

(56) References Cited

U.S. PATENT DOCUMENTS

| | | | | |
|---|---|---|---|---|
| 3,647,679 | A | 3/1972 | Kirk | |
| 4,441,988 | A | 4/1984 | Irvine | |
| 7,638,664 | B2 * | 12/2009 | Peters et al. | 585/310 |
| 2012/0273392 | A1 | 11/2012 | Serban | |

OTHER PUBLICATIONS

U.S. Appl. No. 13/682,061, filed Nov. 20, 2012, Sadler et al.
International Search Report for PCT/US2013068406, mailing date Feb. 20, 2014.

* cited by examiner

*Primary Examiner* — Thuan D Dang
(74) *Attorney, Agent, or Firm* — Arthur E Gooding

(57) ABSTRACT

A process is presented for increasing the aromatics content in a reformate process stream. The process modifies existing processes to change the operation without changing the reactors or heating units. The process includes bypasses to utilize heating capacity of upstream heating units, and passes the excess capacity of the upstream heating units to downstream process streams.

5 Claims, 2 Drawing Sheets

HIGH TEMPERATURE REFORMING PROCESS FOR INTEGRATION INTO EXISTING UNITS

FIELD OF THE INVENTION

The present invention relates to processes for the production of aromatic compounds from a hydrocarbon stream. In particular, the process is an improvement to increase the amount of aromatic compounds such as benzene, toluene and xylenes in a hydrocarbon feedstream.

BACKGROUND OF THE INVENTION

The reforming of petroleum raw materials is an important process for producing useful products. One important process is the separation and upgrading of hydrocarbons for a motor fuel, such as producing a naphtha feedstream and upgrading the octane value of the naphtha in the production of gasoline. However, hydrocarbon feedstreams from a raw petroleum source include the production of useful chemical precursors for use in the production of plastics, detergents and other products.

The upgrading of gasoline is an important process, and improvements for the conversion of naphtha feedstreams to increase the octane number have been presented in U.S. Pat. Nos. 3,729,409; 3,753,891; 3,767,568; 4,839,024; 4,882,040; and 5,242,576. These processes involve a variety of means to enhance octane number, and particularly for enhancing the aromatic content of gasoline.

While there is a move to reduce the aromatics in gasoline, aromatics have many important commercial uses. Among them include the production of detergents in the form of alkyl-aryl sulfonates, and plastics. These commercial uses require more and purer grades of aromatics. The production and separation of aromatics from hydrocarbons streams are increasingly important.

Processes include splitting feeds and operating several reformers using different catalysts, such as a monometallic catalyst or a non-acidic catalyst for lower boiling point hydrocarbons and bi-metallic catalysts for higher boiling point hydrocarbons. Other improvements include new catalysts, as presented in U.S. Pat. Nos. 4,677,094; 6,809,061; and 7,799,729. However, there are limits to the methods and catalysts presented in these patents, and which can entail significant increases in costs.

Improved processes are needed to reduce the costs and energy usage in the production of aromatic compounds.

SUMMARY OF THE INVENTION

The present invention is a process for the reformation of hydrocarbons in a hydrocarbon process stream. In particular, the present invention is for the improvement of existing systems to increase the aromatic content of a hydrocarbon feedstream. The process includes the change in operation of an existing system of reforming reactors, and the redirection of process streams within a reforming reactor system.

The process for increasing aromatics production includes passing a hydrocarbon feedstream through a plurality of reforming reactors in a series arrangement. The feedstream to each reactor passes through at least one heating unit to generate a heated feedstream. At least one of the heated feedstreams is split into at least two portions with a first portion passed to a reforming reactor, and where each reactor generates an effluent stream having an increase in the amount of aromatics. The second portion is passed to a downstream effluent stream and combined with the effluent stream and passed to a downstream heating unit.

In one embodiment, the first reactor in the series is operated at a first temperature, and the subsequent reactors in the series are operated at a different temperature, where the first temperature is below the temperature of the subsequent reactors.

Other objects, advantages and applications of the present invention will become apparent to those skilled in the art from the following detailed description and drawings.

DETAILED DESCRIPTION OF THE INVENTION

Figure 1:
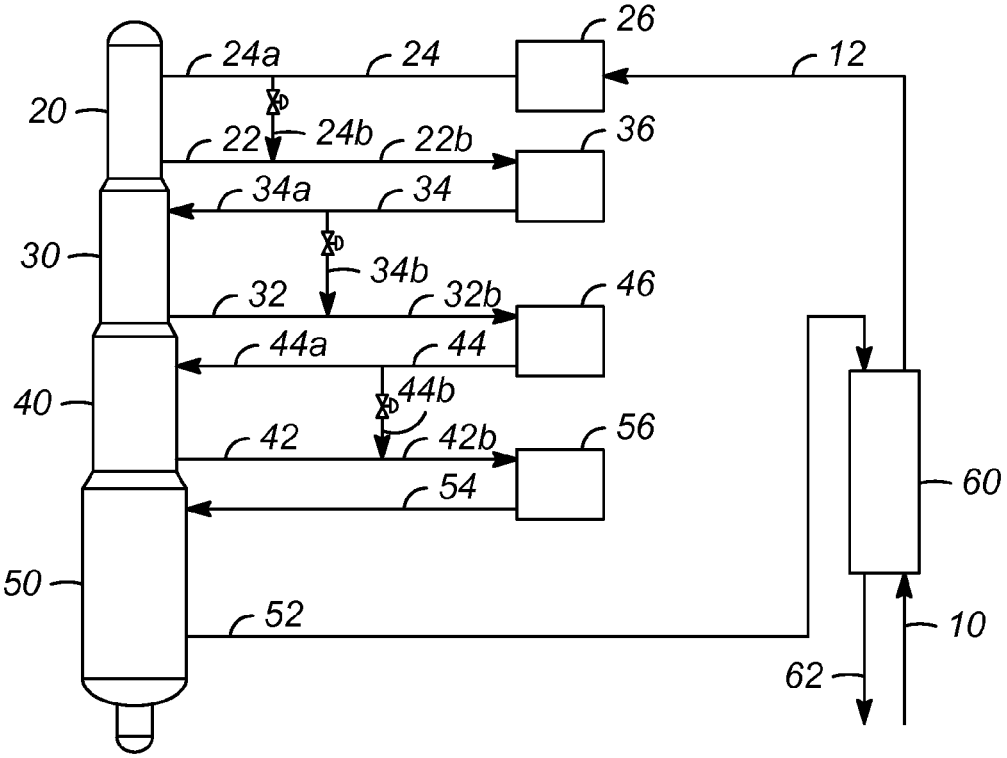
FIG. 1 is a diagram of a first embodiment of the invention for utilizing upstream heaters to heat a feed for downstream processing.

The present invention is directed to improving the yields of aromatics from a hydrocarbon feedstream. The process is a method of improving existing units without replacing reactors, but utilizing new flow and delivery of the process streams to reactors for the conversion of non-aromatics to aromatic compounds. In particular the process aims to increase yields of C6 to C8 aromatics.

There is an increased demand for aromatics. Important aromatics include benzene, toluene, and xylenes. These aromatics are important components in the production of detergents, plastics, and other high value products. With increasing energy costs, energy efficiency is an important aspect for improving the yields of aromatics. The present invention provides for understanding the differences in the properties of the different components in a hydrocarbon mixture to develop a better process.

The dehydrogenation and aromatization process of converting hydrocarbon streams lean in aromatics to hydrocarbon streams rich in aromatics is an endothermic process with the addition of energy to maintain useful reaction temperatures. The process requires a series of reactors with reactor interheaters. One of the problems is the ability to provide sufficient downstream heat to the process stream. The present invention allows for the shifting of heating loads on a process stream to downstream reactors without replacing expensive heaters or reactors.

A hydrocarbon stream is comprised of many constituents, and each constituent behaves differently under different conditions. The constituents can be divided into larger classes of compounds, where one class, such as paraffins, comprises many different paraffinic compounds. The dehydrogenation process is an endothermic process which requires a continuous input of energy to heat the process stream in the reactor. The greater the endothermicity, the greater the temperature drop within the reactor, and therefore the greater the amount of heat that is to be added to maintain the reaction. The dropping of temperature reduces the reaction rate and reduces the conversion. This requires additional heat to maintain a desired reaction rate.

Among the constituents in the hydrocarbon stream, the amount of endothermicity varies considerably. Energy usage in the dehydrogenation process can be reduced by separating out the individual constituents, but would be increased in the endeavor to separate the constituents. However, the reaction rates for the different constituents, and for the different classes of compounds varies. These variations change with temperature, such that different reactions, and different operating temperatures allow for a partial selectivity of the dehydrogenation process over some constituents and classes of compounds.

Compounding problems in the dehydrogenation process are the conversion rates for some of the constituents. In order to achieve good conversion of C6 and C7 paraffins to aromatic compounds, high temperatures and relatively short contact times are required. With the high endothermicity, control and maintenance of high reaction temperatures can be difficult. The hydrocarbon stream of primary interest is a full boiling range naphtha having olefins, naphthenes, paraffins, and aromatics, and the process is aimed at converting the non-aromatics to higher value aromatic compounds.

It has been found that the aromatics production in existing units can be increased by reducing the inlet temperatures of the upstream reactors and increasing the inlet temperatures of the downstream reactors for a group of reactors in a series arrangement. This process shifts the temperatures downstream to create additional conversion in the downstream reactors. Currently, there is insufficient downstream heater duty, and excess capacity in the upstream heaters. By shifting some of the upstream heater duty to downstream reactor inlet streams, the aromatics production can be increased. The shift of heating duty is performed by including bypasses for a portion of the feedstreams to the reactors.

In one embodiment, as shown in FIG. 1, the process for the production of aromatic compounds includes passing a hydrocarbon feedstream 10 through a plurality of reactors 20, 30, 40, 50 with each reactor generating an effluent stream 22, 32, 42, 52. Each reactor has a feedstream 24, 34, 44, 54 that has passed through a heating unit 26, 36, 46, 56. At least one of the feedstreams, 24, 34, 44, 54, such as the first feedstream 24 is split into at least two portions 24*a*, 24*b*. A first portion 24*a* is passed to the first reactor 20 to generate a first reaction effluent stream 22, and the second portion 24*b* is combined with a downstream effluent stream 22. The combined stream 22*b* is passed to a heating unit 36.

The process can include splitting a second heated reactor feedstream 34 into at least two portion 34*a*, 34*b* and passing the first portion 34*a* to a second reactor 30 to generate a second reactor effluent stream 32. The second portion 34*b* is combined with the second reactor effluent stream 32 to generate a combined stream 32*b*, and the combined stream 32*b* is passed to a second heating unit 46, thereby generating a third heated reactor feedstream 44.

The process can further include splitting the third heated reactor feedstream 44 into at least two portions 44*a*, 44*b*. The first portion 44*a* is passed to the third reactor 40 to generate a third reactor effluent stream 42. The second portion 44*b* is combined with the effluent stream 42 to generate a third reactor interheater feedstream 42*b*. The third interheater 56 generates a combined heated effluent stream 52 for feed to a downstream reactor 50. For a four reactor system, the fourth reactor effluent stream 52 is a product stream.

The process can further include passing the product stream 52 through a combined feed heat exchanger 60 to generate a cooled product stream 62 and a preheated feedstream 12. The preheated feedstream 12 can be passed through a charge heater 26 to raise the feedstream 10 to the first reactor temperature. The charge heater 26 and feed exchanger 60 provide excess heating capacity, which is passed to subsequent feedstreams through the by-passes to provide additional capacity to the downstream interheaters.

The present invention is operated with the first reactor operated at a first inlet temperature and the downstream reactors operated at an inlet temperature greater than the first inlet temperature of the first reactor. In one embodiment, the reactors are operated at different inlet temperatures where each downstream reactor is operated at an inlet temperature greater than the preceeding reactor inlet temperature in the series.

Figure 2:
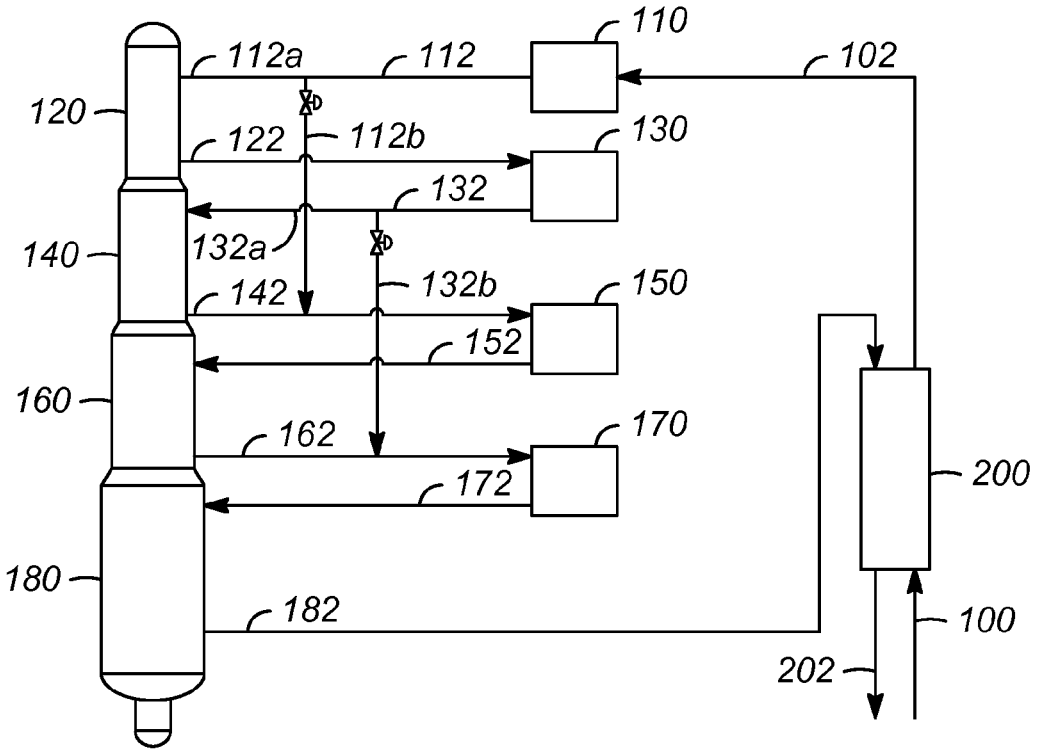
FIG. 2 is a diagram of a second embodiment of the invention for utilizing upstream heaters to heat a feed for downstream processing.

In a second embodiment, as shown in FIG. 2, the process for increasing the aromatic content of a hydrocarbon stream allows for passing a portion of a heated feedstream to a downstream reactor that is beyond the next reactor in the series, and uses at least three reactors. The process includes passing a hydrocarbon feedstream 100 to a charge heater 110 to generate a first heated stream 112. The hydrocarbon feedstream 100 can be passed through a feed heat exchanger 200 to first preheat the hydrocarbon feedstream 100 and passing the preheated feedstream 102 through the charge heater 110. The first heated stream is split into a first portion 112*a* and a second portion 112*b*. The first portion 112*a* is passed to a first reactor 120 to generate a first effluent stream 122. The first effluent stream 122 is passed to a first reactor interheater 130 to generate a second heated stream 132. The second heated stream 132 is split into a first portion 132*a* and a second portion 132*b*. The first portion 132*a* is passed to a second reactor 140 to generate a second effluent stream 142. The second effluent stream 142 and the second portion of the first heated stream 112*b* are passed to a second reactor interheater 150 to generate a third heated stream 152. The third heated stream 152 is passed to a third reactor 160 to generate a third effluent stream 162. The third reactor effluent stream 162 and the second portion of the second heated stream 132*b* are passed to a third reactor interheater 170 to generate a fourth heated stream 172. The fourth heated stream 172 is passed to a fourth reactor 180 to generate a reactor product stream 182.

In one variation, the reactor product stream 182 is passed through a heat exchanger 200 and the hydrocarbon feedstream 100 is passed through the heat exchanger 200 to cool the product stream 202 and preheat the hydrocarbon stream 102.

The process is operated where the inlet temperature to the first reactor is less than the inlet temperature to the second reactor. In one embodiment, of the operation, the first reactor inlet temperature is less than all subsequent reactor inlet temperatures. The process seeks to maximize the conversion, and to that end, the operation can include each subsequent reactor having an inlet temperature greater than the inlet temperature of the preceeding reactor in the series. Or, this is operated with the inlet reactor temperatures sequentially increasing as the process stream passes through the reactors and reactor interheaters in series.

The temperature of operation is the inlet temperature of the feedstream, and is typically a temperature between 450° C. and 540° C. The space velocity can be increased over normal commercial operating conditions. The reaction conditions include a liquid hour space velocity (LHSV) of the present invention in the range from 0.6 hr-1 to 10 hr-1. Preferably, the LHSV is between 0.6 hr-1 and 5 hr-1, with a more preferred value between 1 hr-1 and 5 hr-1. The catalyst also has a residence time in the reformer between 0.5 hours and 36 hours.

The present invention lowers the first inlet temperature to the first reactor to a temperature less than 540° C., with subsequent reactors having inlet temperatures greater than 540° C. The first reactor inlet temperature is preferred to be between 400° C. and 500° C., with a more preferred inlet temperature between 400° C. and 450° C. The inlet temperature to the subsequent reactors, or second and greater reactors in the series should be greater than 500° C., with a preferred inlet temperature between 510° C. and 600° C., and a more preferred inlet temperature between 520° C. and 560° C.

Due to the elevated temperature, the problems of potential increased thermal cracking can be addressed by having a shorter residence time of the hydrocarbon process stream in the equipment at the elevated temperature, or by moving higher temperatures to downstream reactors. The increased temperature can also increase coking on metallic surfaces of the transfer equipment and the reactor internals.

The process can also include adding compounds to change the ability to reduce the amount of coking. One example is the injection of a sulfur compound, such as HOS, into the feedstream. The presence of a small amount of sulfur reduces the coking in the high temperature reforming.

The reforming process is a common process in the refining of petroleum, and is usually used for increasing the amount of gasoline. The reforming process comprises mixing a stream of hydrogen and a hydrocarbon mixture and contacting the resulting stream with a reforming catalyst. The usual feedstock is a naphtha feedstock and generally has an initial boiling point of about 80° C. and an end boiling point of about 205° C. The reforming reaction converts paraffins and naphthenes through dehydrogenation and cyclization to aromatics. The dehydrogenation of paraffins can yield olefins, and the dehydrocyclization of paraffins and olefins can yield aromatics.

The reforming process is an endothermic process, and to maintain the reaction, the reformer is a catalytic reactor that can comprise a plurality of reactor beds with interbed heaters. The reactor beds are sized with the interbed heaters to maintain the temperature of the reaction in the reactors. A relatively large reactor bed will experience a significant temperature drop, and can have adverse consequences on the reactions. The interbed heaters reheat the process stream as the process stream flows from one reactor bed to a sequential reactor bed within the reformer reactor system. The most common type of interbed heater is a fired heater that heats the fluid and catalyst flowing in tubes. Other heat exchangers can be used.

Reforming catalysts generally comprise a metal on a support. The support can include a porous material, such as an inorganic oxide or a molecular sieve, and a binder with a weight ratio from 1:99 to 99:1. The weight ratio is preferably from about 1:9 to about 9:1. Inorganic oxides used for support include, but are not limited to, alumina, magnesia, titania, zirconia, chromia, zinc oxide, thoria, boria, ceramic, porcelain, bauxite, silica, silica-alumina, silicon carbide, clays, crystalline zeolitic aluminasilicates, and mixtures thereof. Porous materials and binders are known in the art and are not presented in detail here. The metals preferably are one or more Group VIII noble metals, and include platinum, iridium, rhodium, and palladium. Typically, the catalyst contains an amount of the metal from about 0.01% to about 2% by weight, based on the total weight of the catalyst. The catalyst can also include a promoter element from Group IIIA or Group IVA. These metals include gallium, germanium, indium, tin, thallium and lead.

While the invention has been described with what are presently considered the preferred embodiments, it is to be understood that the invention is not limited to the disclosed embodiments, but it is intended to cover various modifications and equivalent arrangements included within the scope of the appended claims.

The invention claimed is:

1. A process for the production of aromatic compounds comprising:

passing a naphtha feedstream having olefins, naphthenes, paraffins, and aromatics through a plurality of reforming reactors in a series arrangement, each reforming reactor containing a reforming catalyst to convert paraffin and naphthenes in the naphtha feedstream to aromatics through dehydrogenation and cyclization in the presence of added hydrogen and added sulfur compounds generating an effluent stream, wherein each feedstream to each of reforming reactor passes through a heating unit to generate a heated feedstream for each reforming reactor;

splitting each of the heated feedstreams into at least two portions;

passing the first portion of the split heated feedstream to each of reforming reactors; and combining the second portion of each of the split heated feedstream with a downstream effluent stream, and passing the combined stream to a downstream heating unit and then the next reforming reactor;

wherein the first reactor is operated at a temperature between 400° C. and 500° C., and the following reactors are operated at a second reaction temperature between 500° C. and 600° C., and wherein the second reaction temperature is greater than the first reaction temperature; wherein the reactors are operated as successively greater temperatures.

2. The process of claim 1 further comprising:

splitting a second heated reactor feedstream into at least two portions and passing a first portion to a second reforming reactor to generate a second reactor effluent stream;

combining the second portion of the heated feedstream with the second reactor effluent stream; and passing the combined heated effluent stream to a second reactor interheater in the series.

3. The process of claim 2 further comprising;

splitting a third heated reactor feedstream into at least two portion and passing the first portion to a third reforming reactor to generate a third reactor effluent stream;

combining the second portion of the heated feedstream with the third reactor effluent stream; and passing the combined heated effluent stream to a third reactor interheater.

4. The process of claim 1 wherein the last reforming reactor generates a product stream, further comprising:

passing the product stream through a combined feed heat exchanger; and passing the hydrocarbon feedstream through the combined feed heat exchanger, wherein the product stream is cooled and the feedstream is preheated.

5. The process of claim 1 wherein the inlet temperature of the process stream to each reactor in the series is at a greater temperature than the inlet temperature of the process stream to a preceding reactor in the series.

* * * * *